US007963821B2

(12) United States Patent
Ostendorff

(10) Patent No.: US 7,963,821 B2
(45) Date of Patent: Jun. 21, 2011

(54) TOY VEHICLE TRACK SET

(75) Inventor: Eric C. Ostendorff, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 303 days.

(21) Appl. No.: 11/855,680

(22) Filed: Sep. 14, 2007

(65) Prior Publication Data

US 2009/0075558 A1 Mar. 19, 2009

(51) Int. Cl.
*A63H 18/14* (2006.01)

(52) U.S. Cl. ..... 446/444; 446/429

(58) Field of Classification Search ..... 446/444, 446/429

See application file for complete search history.

(56) References Cited

U.S. PATENT DOCUMENTS

| | | | | |
|---|---|---|---|---|
| 798,102 | A | 8/1905 | Honneus | |
| 798,966 | A | 9/1905 | Johnson | |
| 812,595 | A | 2/1906 | Roberts | |
| 1,527,006 | A | 2/1925 | O'Reilly | |
| 1,599,982 | A | 9/1926 | Bauer | |
| 2,999,689 | A | 9/1961 | Litwinczuk | |
| 3,590,524 | A | 7/1971 | Beny et al. | |
| 3,621,602 | A | 11/1971 | Barcus et al. | |
| 3,636,651 | A | 1/1972 | Lohr et al. | |
| 3,641,704 | A | 2/1972 | Sims et al. | |
| 3,677,469 | A | 7/1972 | Edmission et al. | |
| 3,683,514 | A | 8/1972 | Hughes | |
| 3,726,476 | A | 4/1973 | Porter et al. | |
| 3,762,095 | A | 10/1973 | Merino et al. | |
| 3,814,021 | A | 6/1974 | McHenry | |
| 3,860,238 | A | 1/1975 | Kojima | |
| 4,174,587 | A | 11/1979 | Morin et al. | |
| 4,383,688 | A | 5/1983 | Prehodka | |
| 4,394,961 | A | 7/1983 | Muller | |
| 4,516,953 | A | 5/1985 | Hippely et al. | |
| 4,519,789 | A | 5/1985 | Halford et al. | |
| 4,558,867 | A | 12/1985 | Hippely | |
| 4,575,350 | A | 3/1986 | Hippely et al. | |
| 5,038,685 | A | 8/1991 | Yoneda et al. | |
| 5,102,133 | A | 4/1992 | Chilton et al. | |
| 5,234,216 | A | 8/1993 | Ostendorff | |
| 5,452,893 | A * | 9/1995 | Faulk et al. | 463/68 |
| 5,873,521 | A | 2/1999 | Ernst | |

(Continued)

FOREIGN PATENT DOCUMENTS

GB 2103949 A 3/1983

(Continued)

OTHER PUBLICATIONS

Written Opinion dated Apr. 9, 2009 for International Application No. PCT/US2008/076209, International Filing Date Sep. 12, 2008.

(Continued)

*Primary Examiner* — Gene Kim
*Assistant Examiner* — Michael D Dennis
(74) *Attorney, Agent, or Firm* — Cantor Colburn LLP

(57) ABSTRACT

A stunt arrangement for a toy vehicle including a launching section configured to launch a propelled toy vehicle into flight, a capturing section configured to receive the toy vehicle from the flight, including a narrowing cross-section configured to align a longitudinal axis of the toy vehicle with a desired direction of travel, and a reorienting section coupled to an outlet of the capturing section configured to upright the toy vehicle if the vehicle exits the capturing section partly or completely inverted.

21 Claims, 6 Drawing Sheets

U.S. PATENT DOCUMENTS

| | | | | |
|---|---|---|---|---|
| 5,899,789 | A | 5/1999 | Rehkemper et al. | |
| 6,089,951 | A | 7/2000 | Ostendorff | |
| 6,170,754 | B1 | 1/2001 | Halford | |
| 6,216,600 | B1 | 4/2001 | Verret | |
| 6,241,573 | B1 | 6/2001 | Ostendorff et al. | |
| 6,676,480 | B2 | 1/2004 | Sheltman | |
| 6,695,675 | B1 | 2/2004 | Ngan | |
| 6,793,554 | B1 | 9/2004 | Newbold | |
| 6,913,508 | B2 | 7/2005 | Hornsby et al. | |
| 6,951,497 | B1 | 10/2005 | Ngan | |
| 2003/0224697 | A1* | 12/2003 | Sheltman et al. | 446/444 |
| 2005/0076617 | A1* | 4/2005 | Hellmann et al. | 53/445 |
| 2005/0148281 | A1 | 7/2005 | Sanchez-Castro et al. | |
| 2005/0191938 | A1 | 9/2005 | Sheltman et al. | |
| 2005/0191939 | A1 | 9/2005 | Sheltman et al. | |
| 2005/0287914 | A1 | 12/2005 | Sheltman et al. | |
| 2005/0287915 | A1 | 12/2005 | Sheltman et al. | |
| 2005/0287916 | A1* | 12/2005 | Sheltman et al. | 446/444 |
| 2005/0287917 | A1 | 12/2005 | Sheltman et al. | |
| 2005/0287918 | A1 | 12/2005 | Sheltman et al. | |
| 2005/0287919 | A1 | 12/2005 | Sheltman et al. | |
| 2007/0049160 | A1 | 3/2007 | Matthes et al. | |

FOREIGN PATENT DOCUMENTS

| | | | |
|---|---|---|---|
| GB | 2200297 | A | 3/1988 |
| JP | 03047286 | A | 2/1991 |
| JP | 2001246176 | A | 9/2001 |
| WO | 9201497 | A1 | 2/1992 |
| WO | 9949948 | A1 | 10/1999 |

OTHER PUBLICATIONS

International Search Report dated Apr. 9, 2009 for International Application No. PCT/US2008/076209, International Filing Date Sep. 12, 2008.

* cited by examiner

TOY VEHICLE TRACK SET

BACKGROUND

Play sets for toy vehicles are popular toys which are known to provide entertainment and excitement to a user. These play sets typically include a track configuration intended to guide a propelled toy vehicle, such as a 1/64 scale die-cast metal toy vehicle, through a course. The track configurations include closed-loop continuous track arrangements and open-end arrangements. Toy vehicles are placed on these play set tracks and propelled across the configuration by hand or by an external propulsion means.

To bring increased entertainment and excitement to play sets, track configurations may include features such as intersecting tracks, loop segments, and other types of track configurations known in the art. Additionally, attempts have been made at incorporating jumps into these race sets by which a traveling toy vehicle is briefly separated from the track to ultimately rejoin the track at a downstream location. However, these attempts have been limited due to the complexities of ensuring that the launched toy vehicle lands on the downstream track segment in a proper orientation to thus allow the vehicle to continue its course of travel. For example, a launched toy vehicle which re-enters the track inverted or misaligned relative to a longitudinal axis of the track would prohibit wheeled forward progress and thus interrupt play.

Accordingly, a play set for toy vehicles is desired which can provide the entertainment and excitement of a toy vehicle launched from a track and which also includes provisions for returning the launched vehicle to the track in a proper orientation to allow continuous play despite any misalignment which may occur during flight.

BRIEF SUMMARY OF INVENTION

The invention provides toy vehicle play set including a stunt arrangement launching section configured to launch a propelled toy vehicle into flight, a capturing section configured to receive the toy vehicle from the flight, including a narrowing cross-section configured to align a longitudinal axis of the toy vehicle with a desired direction of travel, and a reorienting section coupled to an outlet of the capturing section configured to upright the toy vehicle if the vehicle exits the capturing section partly or completely inverted.

The invention further provides a play set for toy vehicles including a propulsion arrangement having at least one booster assembly configured to receive a toy vehicle at an inlet and to propel the toy vehicle through an outlet, a first track segment configured to guide the toy vehicle to the inlet, a stunt arrangement disposed in association with the outlet and including a disorienting section configured to rotate the toy vehicle about its longitudinal axis or about an axis angled thereto, and a reorienting section configured to align the longitudinal axis of the toy vehicle with a direction of travel and to engage a wheeled surface of the toy vehicle with a second track segment configured to return the toy vehicle to the propulsion arrangement.

Still further, the invention provides a stunt arrangement for toy vehicles including a funnel section configured to receive a toy vehicle from flight, a tail portion having a first end connected to a bottom of the funnel and a curve portion extending from the funnel through at least thirty degrees to a second end disposed oppositely from the first end, and a cylinder connected to the second end and rotatable about a longitudinal axis, the cylinder including a plurality of frictional elements extending along a length of the cylinder and generally parallel to the longitudinal axis, wherein the funnel and tail portion are configured to position the received toy vehicle in a front or tail forward position and the frictional elements are disposed to engage a non-wheeled surface of the toy vehicle and to rotate the vehicle onto a wheeled surface thereof.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1A:
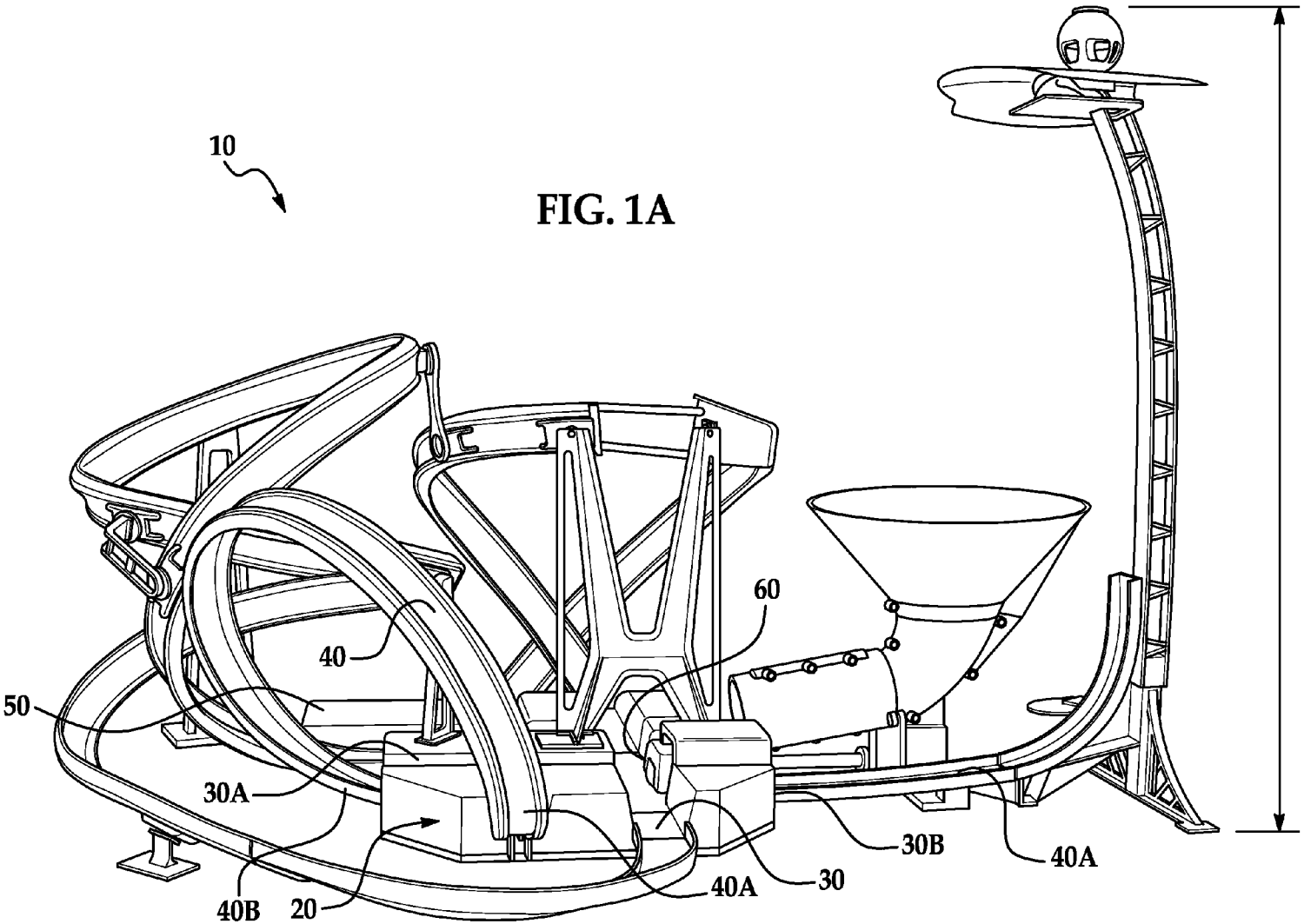
FIG. 1A illustrates a perspective view of a play set according to an embodiment of the invention.
Figure 1B:
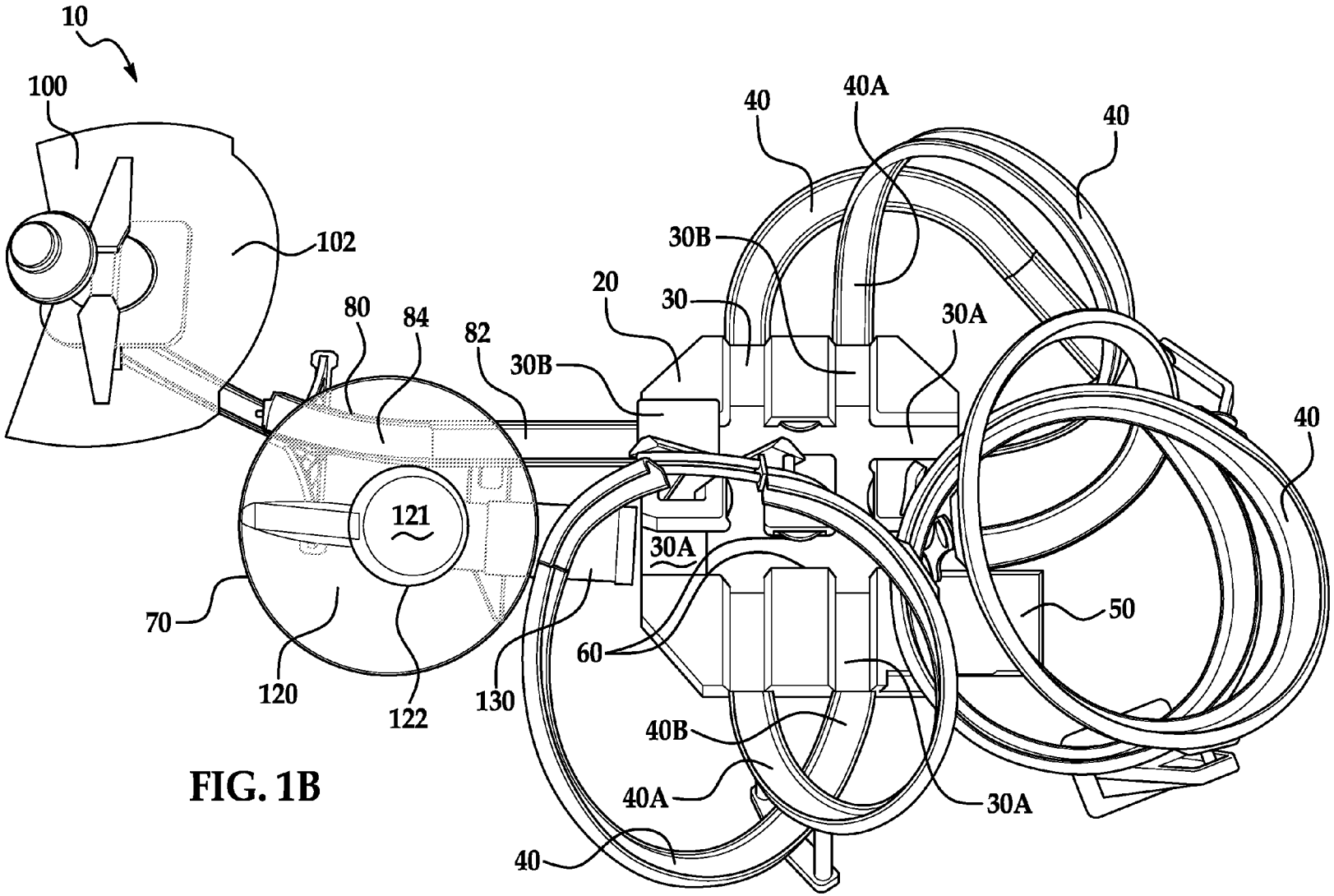
FIG. 1B illustrates a plan view thereof.

FIG. 1A shows an exemplary play set 10 for toy vehicles in one embodiment according to the present invention. The play set 10 includes a base 20 having four propelling tracks 30 defined therein and a plurality of external tracks 40 extending from and then ultimately returning to the base 20. Each propelling track 30 includes an inlet 30A and an outlet 30B for allowing, respectively, ingress and egress of a toy vehicle. Correspondingly, each external track 40 includes an inlet 40A and an outlet 40B. The inlets 40A of the external tracks are fitted to the outlets 30B of the propelling tracks. Similarly, the outlets 40B of the external tracks are fitted to the inlets 30A of the propelling tracks. This arrangement allows for continuous movement of the toy vehicle throughout the play set 10. In this exemplary embodiment, the base includes four intersecting propulsion tracks 30 and four corresponding external tracks 40. The external tracks 40 include stunt features described in more detail below.

The propelling tracks 30 and the external tracks 40 are each designed for use with toy vehicles that ride on wheels disposed in contact with the propelling tracks 30 and the external tracks 40. The base 20 further includes a propulsion unit configured to accelerate the toy vehicles through the propulsion tracks 30, sending the vehicles at relatively high speeds into the external tracks 40. In this example, the propulsion unit is powered by a motor 50 that is coupled to one or more booster wheels 60 that are each arranged in the propelling tracks 30. The booster wheels 60 may be made of rubber (PVC), foam, or other materials known in the art. Each propelling track 30 may include a single wheel 60 or two oppositely disposed wheels 60. The motor 50, which may be a 6-volt electric motor, rotates the booster wheels 60 at high speeds such that vehicles travel along the propelling tracks 30 contact the rotating wheels 60 and are propelled forward thereby at high speeds that insure the return of the vehicles to the base 20 after each track 40 is traversed. As such, vehicles traveling through the play set 10 may traverse long series of loops and other stunt features of multiple external tracks 40 as long as the play set 10 is operated or until the vehicles crash into one another at the intersections of the propulsions tracks 30.

As mentioned, the external tracks 40 may include any combination of stunts arrangements. In the illustrated embodiment, the tracks 40 each include a loop, twist, and/or spiral section or a combination thereof. Of course, other looping and/or twisting arrangements of the external tracks 40 are contemplated.

Figure 2:
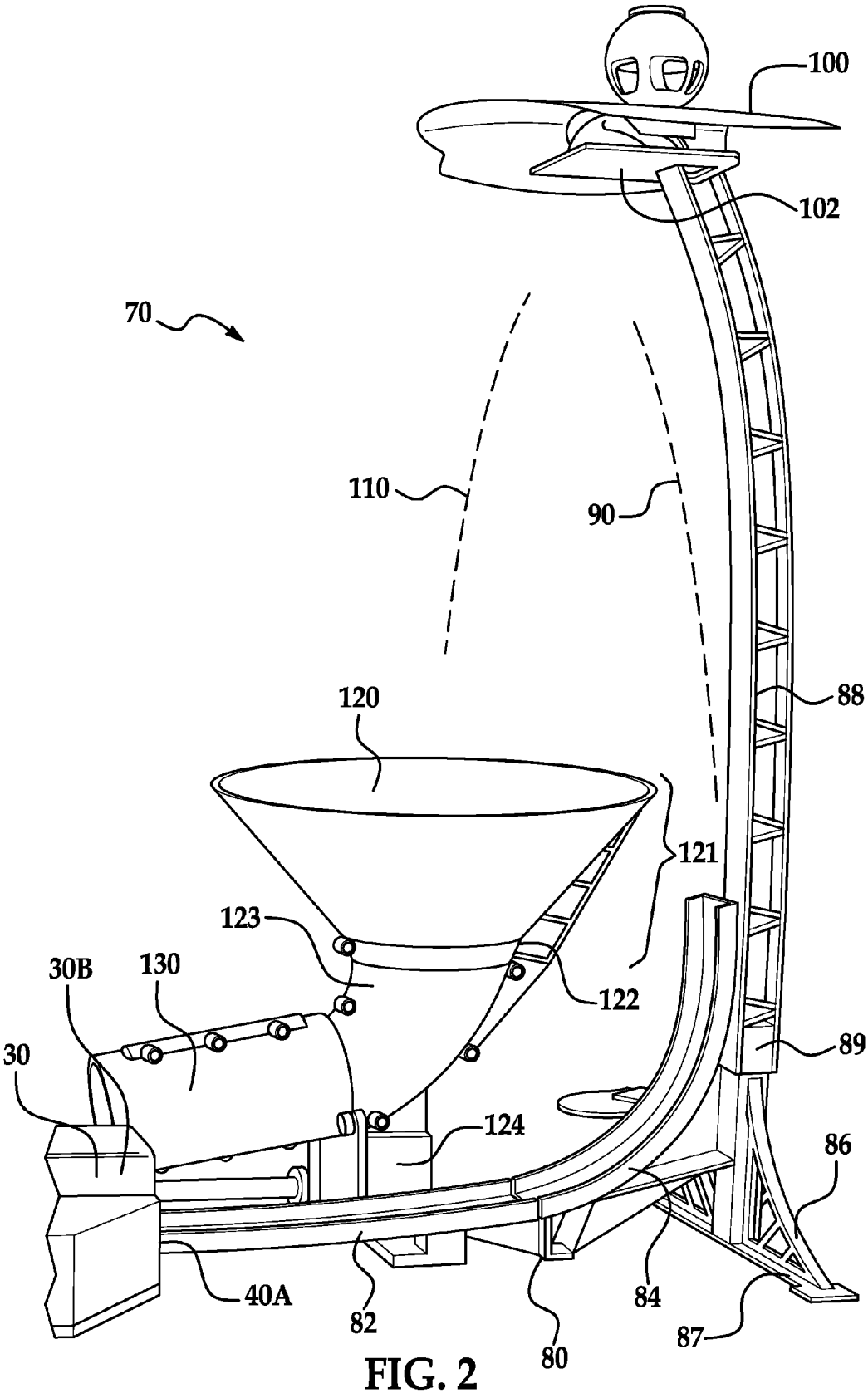
FIG. 2 illustrates a jumping and capturing stunt track arrangement for a play set, according to an embodiment of the invention.

At least one of the external tracks 40 may include a jumping and capturing stunt track arrangement 70, as best seen in FIG. 2. The stunt track arrangement 70 includes a launching section 80, first and second paths of travel 90 and 110, a deflection section 100 disposed generally between the free flight sections, a capturing section 120, and a reorienting section 130.

The launching section 80 is composed of a straight track 82 having an inlet 40A affixed to an outlet 30B of the propulsion track 30. The launching section 80 further includes a quarter circle track portion 84 disposed in continuation of the straight track 82 and opposite from the inlet 40A.

Thus, a vehicle having a sufficient initial velocity as propelled from the outlet 30B of the base 20 will traverse the straight track 82 and the quarter circle track 84 of the launching section 80 and then enter free flight at the termination of the quarter circle portion. Such toy vehicle will then generally travel through the first path of travel 90. Subsequently, the vehicle may impact a shield 102 of the deflection section 100 and fall generally through the second path of travel 110 toward a hopper 122 of the capturing section 120. Alternatively, the vehicle may not impact the shield 102 but instead simply reach an apex of flight and then descend downwardly toward the hopper 122. In one embodiment, a toy vehicle launched from the quarter circle track 84 may travel upward approximately thirty inches before beginning its descent toward the hopper 122. The quarter circle track 84 may be angled slightly in a direction toward the hopper 122 in order to ensure that the flight of the vehicle terminates in the hopper 122. The vehicle then proceeds through the hopper 122 and exits the capturing section 120 into a reorienting cylinder of the reorienting section 130. As will be discussed in further detail herein, the hopper 122 is configured to catch the descending vehicle and to orient the vehicle in a head or tail first position and the reorienting section 130 is configured to upright the vehicle if inverted. The properly oriented and uprighted vehicle then rolls out of the reorienting section 130 and into an inlet 30A of a propulsion track 30. The base 20 may then propel the vehicle elsewhere within the race set 10.

The launching section 80 includes the quarter circle track 84 and a stand 86 for support. The straight track 82 may be substantially flat or may gradually or abruptly slope upward or downward to the quarter circle track 84. The quarter circle track 84 curves upward from the proximate end of the straight track 82 and ends abruptly in a substantially vertical orientation.

The stand 86 supports the quarter circle track 84 such that it remains in a consistent position during the operation of the play set 10. The stand 86 includes a pedestal 87 to be positioned on a support surface such as a table, a floor, etc. A spine 88 extends in a substantially vertical direction from the pedestal 87 and is coupled thereto by a connector 89.

The first path of travel 90 extends from the end of the quarter circle track 84, generally parallel to the spine 88, and terminates approximately at the deflection section 100.

Figure 3:
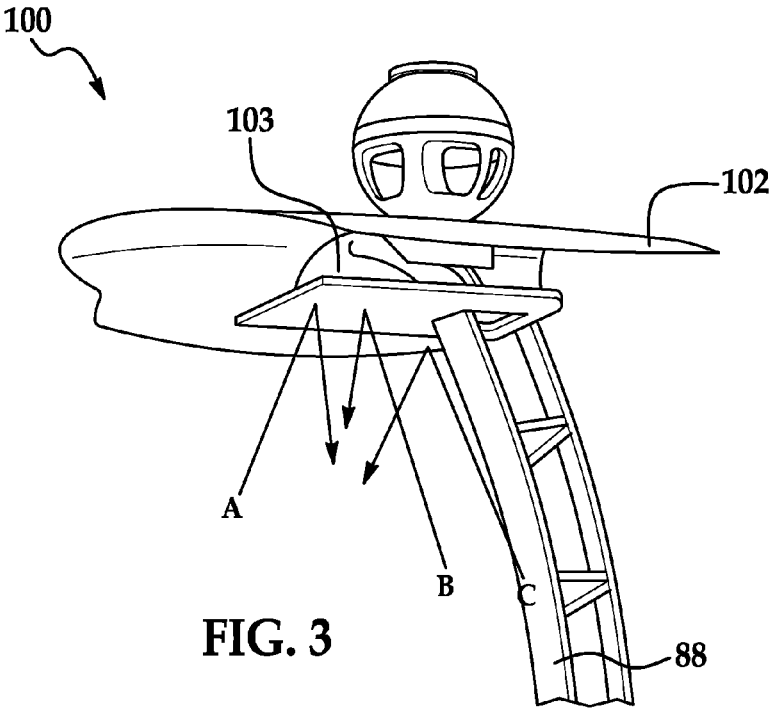
FIG. 3 illustrates a deflection section of the stunt track arrangement of FIG. 2.

As best seen in. FIG. 3, the deflection section 100 is disposed at an upper portion of the spine 88 and includes an overhanging member 103 coupled to an upper end of the spine portion 88 and is configured to support the shield 102. As mentioned, the shield 102 is disposed and oriented to be impacted by vehicles in flight. The shield 102 is further configured to redirect the vehicles downward into the hopper 122. According to the illustrated embodiment of the invention, the shield 102 is made of a transparent or semi-transparent material (e.g., clear plastic), and has a generally parabolic shape. The substantially transparent material of the shield 102 allows users to observe vehicles impacting the shield 102 and generally does not obstruct a view of the stunt arrangement 70 from above, nor of the play set 10. In addition, the shield 102 is designed to elastically respond to impacts of the vehicles and to absorb some of the force transferred by these impacts. The generally parabolic shape of the shield 102 encourages incoming vehicles having different initial trajectories, such as trajectories A, B, and C in FIG. 3, to be aimed toward a common target D (e.g., the hopper 122 shown in FIG. 2) upon their respective impacts with the shield 102.

It is noted that the stand 86 which supports the quarter circle track 84 and spine 88 is described herein by way of example only and may include various constructions as long as the constructions are sufficiently stable to remain in position during the operation of the play set 10.

Referring again primarily to FIGS. 2 and 3, in the illustrated embodiment, the spine 88 of the stand 86 includes a curved structure whereby the spine 88 diverges from a vertical axis of the upper portion of the quarter circle track 84 in a direction toward the straight track 82. This curvature extends the horizontal reach of the stand 88 in order to allow the shield 102 to be positioned in an appropriate position above the launching section 80 in order to facilitate impact of the toy vehicles and redirection thereof to the hopper 122. The spine 88 and its curvature also serves to realign a vehicle with the first path of travel 90 if the vehicle is misdirected upon departing from the quarter circle track 84. That is, a misdirected launched toy vehicle may impact a portion of the spine 88 and rebound into one of the exemplary flight paths A, B, and C shown in FIG. 3. Of course, the described curved nature of the spine 88 is merely exemplary. In another embodiment, the spine 88 may include straight structure which extends vertically from the upper portion of the quarter circle track 84. Alternatively, the spine 88 may extend at an angle to the vertical or may include any combination of curved, vertical, and angled sections.

As mentioned, the first path of travel 90 extends generally from the upper portion of the quarter circle track 84 to the shield 102 and the second path of travel 110 extends generally from a lower edge of the shield 102 to an upper edge of the hopper 122 of the capturing section 120. While in free flight in the first and/or second paths of travel 90, 110, vehicles may rotate freely about their longitudinal axis, about an axis perpendicular thereto, or about any axis therebetween. That is, while traversing the paths of travel 90 and 110, a toy vehicle is free to partake in exciting and unpredictable spins, tumbles, flips, etc. Accordingly, the toy vehicle may not reach the capturing section 120 in the proper wheel-down orientation and/or the vehicle may be misaligned relative to the track 40 leading to the base 20. For example, a vehicle may reach the capturing section 120 inverted (wheels-upward) and perpendicular to a direction of travel of the track 40. The capturing section 120 and the reorienting section 130 are configured to correct the orientations of any such misaligned vehicles in order to ensure that the vehicle continues through the stunt arrangement 70 and, if desired, elsewhere within the play set 10.

Figure 4:
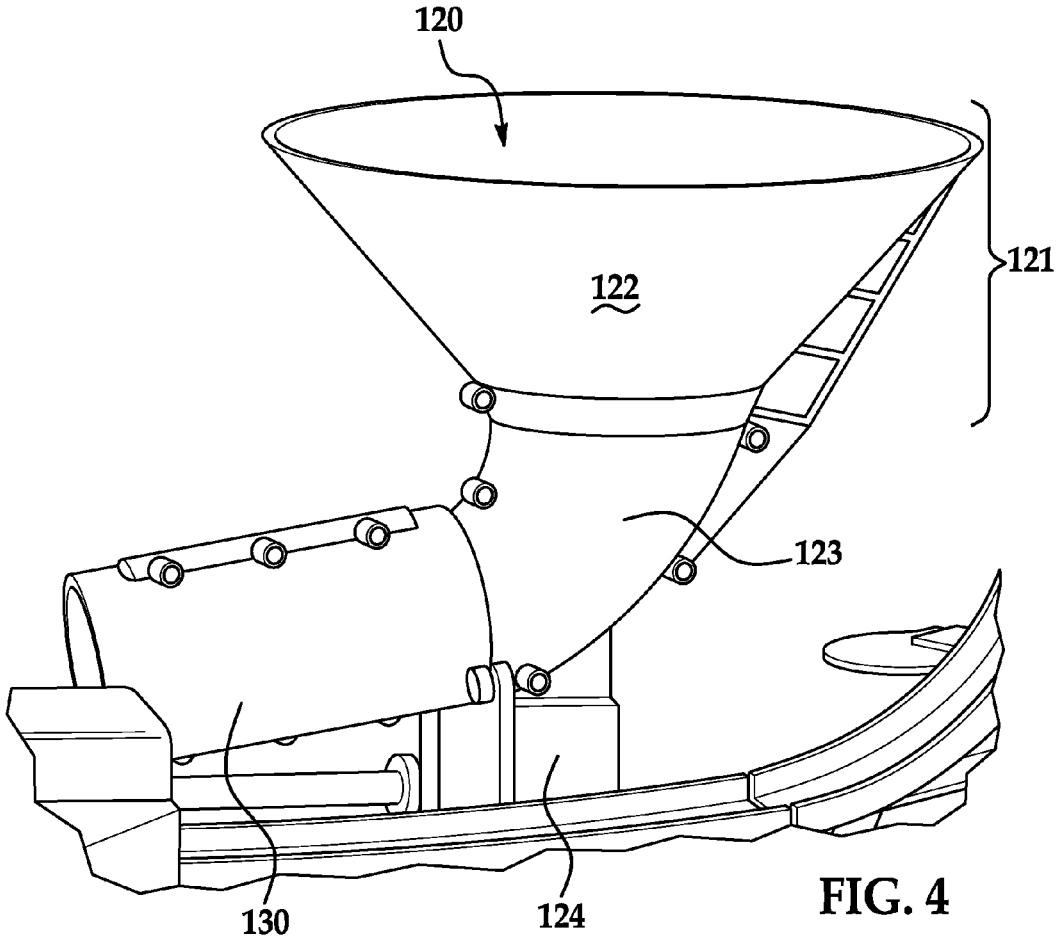
FIG. 4 illustrates a capturing section of the stunt track arrangement of FIG. 3.

As can be seen in FIG. 4 the hopper 122 of the capturing section 120 includes a collector 121, a tail 123 and a supporter 124. The collector 121 is shaped like a large funnel with an open upper end that is significantly larger then any vehicle to be used with the play set 10. From the upper end, the collector 121 tapers downwardly toward an outlet having a diameter which is large enough to allow single vehicles to exit. Here the collector 121 is connected to the tail 123 which essentially includes a tube of circular cross-section which includes a decreasing diameter so as to taper in a direction toward the reorienting section 130. Here, the tail 123 traverses a curve having an arc in the range of 0°-90° and, particularly, about 30°.

Furthermore, the narrowing end of the collector 121 and the tapering and curvature of the tail 123 assist descending vehicles to be positioned either head first or tail first, i.e., frontward or backward, for entry into the reorientation section 130. In this manner, a descending vehicle strikes a portion of the collector 121 where the relatively steep walls of the collector 121 result in the vehicle sliding downward toward the tail 123. The circular cross-sectional shape and the decreasing diameter of both the collector 121 and the tail 123, and the curvature in the tail 123, naturally orient the downwardly sliding toy vehicle into a head or tail first position. That is, the collector 121 and the tail 123 are configured such that the toy vehicle may not pass therethrough when its longitudinal axis is not substantially aligned with the longitudinal axes of the collector 121 and the tail 123. In this way, the vehicle is delivered in the frontward or backward position to the reorienting section 130.

The collector 121 may be made of a similar transparent or semi-transparent material as that of the shield 102 to allow users to observe the vehicles being collected and to insure that any impacts between the vehicles and the collector 121 will be at least partially absorbed to thus minimize the occurrence of vehicles ejecting from the collector 121 upon hard impact.

The supporter 124 is positioned on a support surface that may be level with the surfaces on which the pedestal 87 of the stand 86 and the base 20 are positioned. The supporter 124 may be connected to any part of the collector 121 or the tail 123 and maintains a position of the capturing section 120 during the operation of the play set 10.

Figure 5:
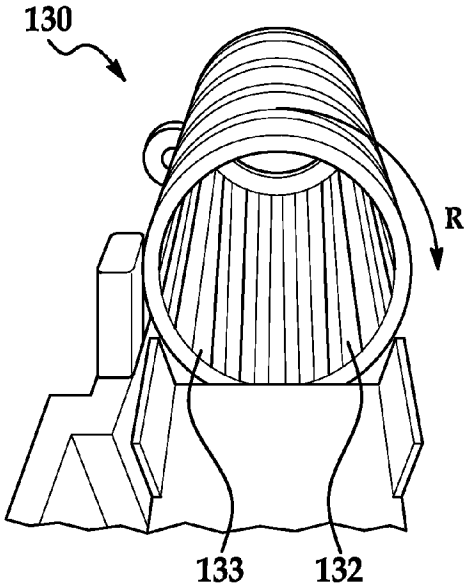
FIG. 5 illustrates a substantially axial view of a reorienting portion of the capturing section of FIG. 4.

As shown in FIGS. 4-5, the reorienting section 130 includes a downwardly angled cylinder which is rotatable at a substantially constant angular speed, R (e.g., at approximately 20-30 RPM), about a longitudinal axis of the cylinder. The reorienting section 130 (sometimes referred to herein as, "the reorienting cylinder 130") may be powered by the motor 50 mentioned previously and/or by a separate power source. An interior of the reorienting cylinder 130 is lined with alternating surfaces 132 and 133. The surfaces 133 are generally smooth and have a relatively lower coefficient of friction with respect to the toy vehicles. The surfaces 132 generally yield a relatively higher coefficient of friction than the smooth interior surfaces 133. The smooth surfaces 133 may simply include the material of which the cylinder 130 is composed, for example, a transparent or semi-transparent plastic material. The surfaces 132 may include strips of a frictional material, such as rubber or plastic, disposed on the interior of the cylinder 130 by adhesive means. Alternatively, the surfaces 132 may result from a liquid application upon the interior of the cylinder 130 or from another physical modification of the cylinder interior. In any event, the surfaces 132 are arranged substantially evenly around an inner surface of the reorienting cylinder 130. The surfaces 132 are aligned generally parallel with each other and in line with the longitudinal axis of the cylinder 130. Thus, as the reorienting cylinder 130 rotates, the surfaces 132 correspondingly rotate about the longitudinal axis of the cylinder.

As discussed, when a toy vehicle enters the reorienting section 130 from the tail 123, the vehicle is generally aligned with the longitudinal axis of the tail 123 and correspondingly with the longitudinal axis of the reorienting section 130. Advantageously, this axis is further in alignment with the direction of travel provided by the propelling track 30 connected to the section 130 opposite from the tail 123. As described, this track section 30 directs a vehicle away from the section 130 and through the base 20. Accordingly, the capturing section 120 delivers a caught vehicle to the reorienting cylinder 130 in axial alignment with the cylinder 130 and with the subsequent propelling track 30.

If a vehicle enters the reorienting section upright with wheels down, the vehicle will simply roll through the reorienting section 130 in accordance with the velocity of the vehicle at the entrance of the cylinder 130. That is, due to the momentum of the vehicle and the downward slope of the cylinder 130, the vehicle will quickly move through the cylinder 130 unaffected by the rotating surfaces 132, 133. However, if the vehicle is partly or completely inverted (e.g., the vehicle is laying on a side or a roof thereof), the vehicle will be prevented from passing through the reorienting tube 130 by the friction between the surfaces 132 and the frame of the vehicle. That is, the friction created between the surface 132 and the vehicle will prevent the vehicle from sliding through the cylinder in the direction of the longitudinal axis thereof. Instead, the vehicle is halted temporarily and the angular momentum of the rotating surfaces 132 will rotate the vehicle about its longitudinal axis to an upright, wheels-down position at which point the vehicle then rolls out of the reorienting section 130 and into the track 30.

Figure 6A:
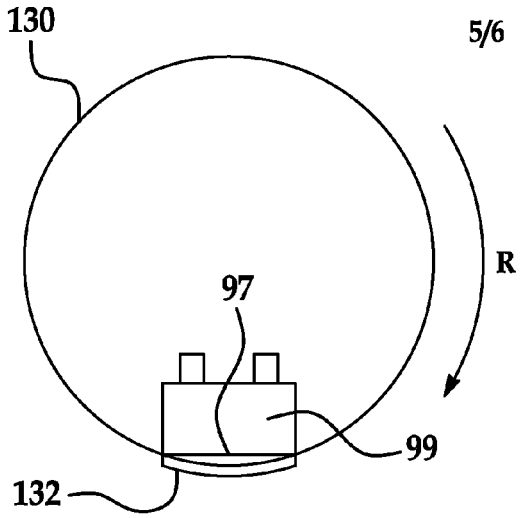
FIGS. 6A-6C illustrates a sequence of operation of the reorienting section of FIG. 5.
Figure 6B:
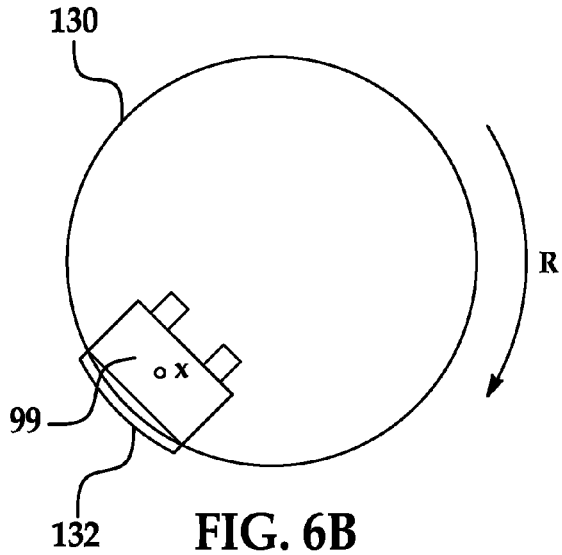
Figure 6C:
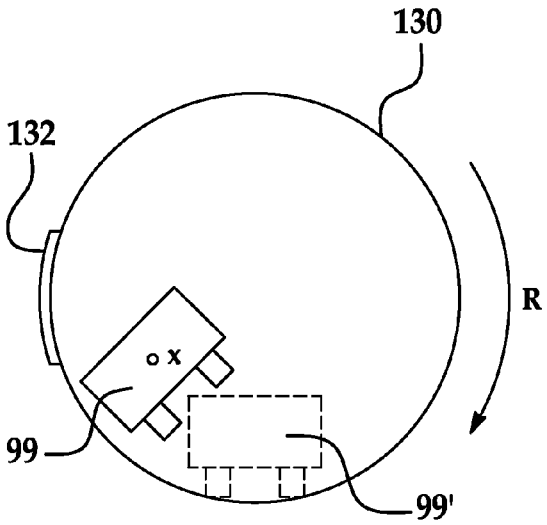

FIGS. 6A-6C show cross-sectional views of the cylinder of the reorienting section 130 during a sequence in which an inverted vehicle 99 is reoriented by action of the cylinder 130. The cylinder 130 is rotating about its axis in the direction R. The vehicle 99 is in the inverted position in FIG. 6A. Thus, a roof 97 of the vehicle 99 engages the cylinder 130 and particularly engages one of the surfaces 132 shown here by a heavy line. In FIG. 6B, the rotation of the cylinder 130 and the engagement between the surface 132 and the vehicle 99 causes the vehicle to rotate about the longitudinal axis of the cylinder 130 in the direction indicated by the arrow R. In FIG. 6C, the surface 132 has imparted enough angular momentum upon the vehicle 99 to rotate it about its axis x approximately 180° so that the vehicle assumes an upright orientation 99'. Now, the vehicle 99 is free to roll through and out of the cylinder 130.

According to embodiments of the invention, the launching section 80, the deflection section 100 and the capturing section 120 may be positioned at various positions relative to one another and may be configured to adjust to those various positions. For example, a height of the deflection section 100 relative to the launching section 80, or the angle of the launching section 80, etc., may be automatically or manually adjusted.

Figure 7:
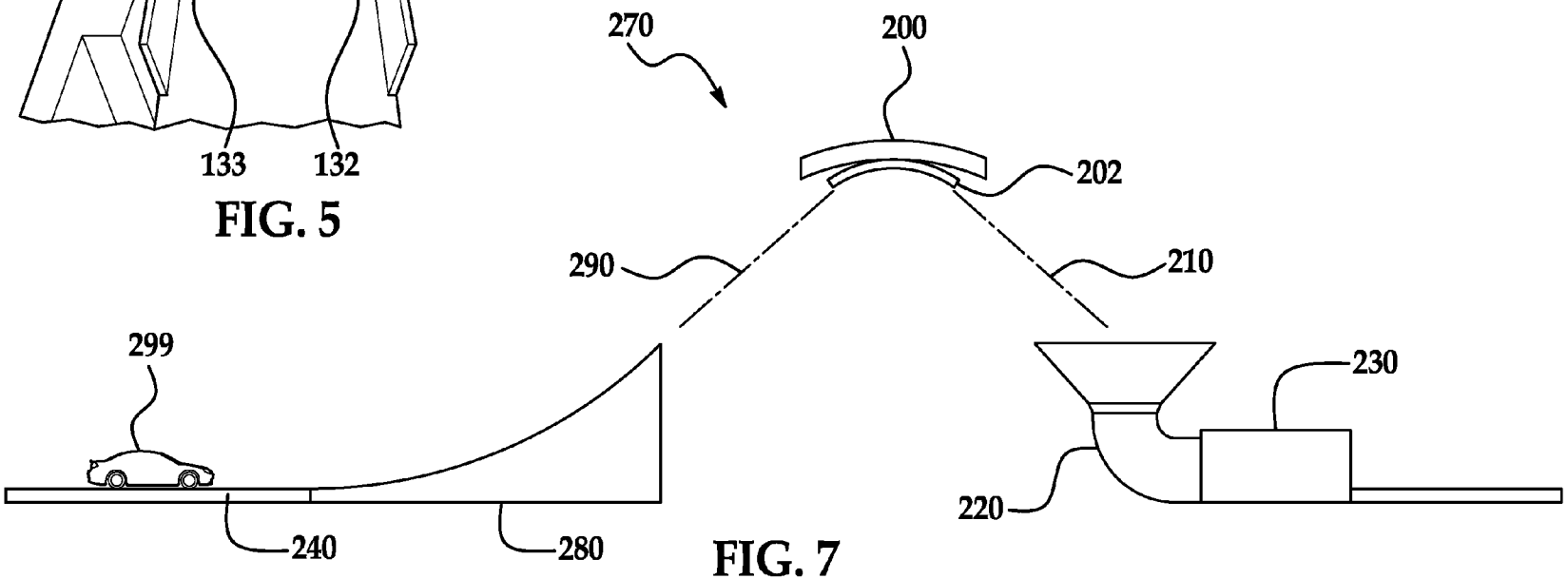
FIG. 7 illustrates a jumping and capturing stunt track arrangement according to another embodiment of the invention.

FIG. 7 shows an alternative embodiment of a stunt arrangement 270 including a launching section 280 directed in a non-vertical direction. For example, the launching section 280 may be angled in a more lateral orientation. As such, a capturing section 220 is positioned a sufficient lateral distance from the launching section 280 in order to capture a toy vehicle 299 in flight. That is, the capturing section 220 is positioned at a termination of a second path of travel 210. A deflection section 200 may be optionally positioned between the first and second paths of travel 290 and 210, as shown in the drawing. A shield 202 of the deflection section 200 may be reshaped or resized in order to receive the impact of the vehicle 299 in flight and to redirect the vehicle toward the capturing section. In any event, as shown, the vehicle 299 is propelled across a track section 240 to the launching section 280 by which the vehicle 299 takes flight and is permitted to tumble, spin, and rotate about any of a plurality of axes. At the end of flight, the vehicle 299 is received by the capturing section 220, is positioned in a head or tail first alignment as discussed, and delivered to the reorienting section 230 which uprights the vehicle 299, if necessary, generally in the manner described above.

The launching angle of the launching section 80 may be configured as desired, in a range from vertical (90°) to nearly horizontal (0°) and even over vertical (90°-180°). The deflection section 100 and the recapturing section 130 would simply be positioned and oriented in accordance with the desired launch angle. Still further, the capturing and reorienting sections 120 and 130 may be utilized without the launching section 80 to orient a toy vehicle traveling along a surface. For example, a stunt arrangement in another embodiment of the invention includes a generally planar track surface upon which a toy vehicle is permitted to tumble, slide, spin, etc. in a direction toward the capturing section 120. Here, the capturing section 120 is a large funneling arrangement disposed at one end of the track surface which gathers the careening, rotating vehicle and, in accordance with description above, orients the vehicle in a head or tail first position and delivers the vehicle to the reorienting section 130 which uprights the vehicle if necessary. The capturing and reorienting sections 120 and 130 may be shaped as shown in FIG. 4 in which case the vehicle would descend into the hopper 122 for orientation. Alternatively, the capturing and reorienting sections 120 and 130 may share a common longitudinal axis, i.e., the capturing section 120 and the tail 123 shares the same straight longitudinal axis as the cylinder 130.

The stunt track arrangement 70 is described in association with the play set 10 by way of example only. The stunt arrangement may be employed in the described continuous play set 10 or as a component in other continuous play sets. The stunt arrangement 70 may be utilized as a portion of a open end play set track configuration where toy vehicles are propelled from a start point to an end point between which the vehicles encounter the stunt arrangement 70 and perhaps other stunt arrangements and/or track configurations. Still further, the stunt arrangement may further be utilized independently as a stand alone play set.

The stunt track arrangement 70 and the play set 10 are described herein as being used in conjunction with the electronically driven booster base 20 which automatically propels toy vehicles therefrom by means of rotating booster wheels. In another embodiment, toy vehicles may be propelled to the arrangement 70 and/or to the play set 10 by a manually operated booster arrangement, such as a pneumatic booster activated by a trigger or pump, or by an impact booster activated by application of a downward force, etc.

As mentioned, the described stunt arrangement 70 and play set 10 may be configured for toy vehicles. Of course the arrangement 70 and set 10 may be configured for any moving toy such as rolling or sliding figurines, rolling balls, etc. Furthermore, the play set 10 and particularly the stunt arrangement 70 may be configured for electronically driven slot vehicles. That is, the track segments 40 and launching segment 80 may include slotting to receive such vehicles and further include conductors as is known in the art for powering such vehicles. The slot vehicles would thus be separated from the track at the launching section 80, allowed to freely rotate in flight, and then captured and reoriented in the sections 120 and 130 as described above. The slot vehicle would then be deposited back onto a slotted track and mated with a slot in a proper orientation for onward travel.

The stunt arrangement 70 may further include magnetic elements to influence the flight of a launched vehicle. For example, such magnetic elements may be disposed at areas on the quarter circle track segment 84. Additionally and/or alternatively, the vehicles 99 used in conjunction with the arrangement 70 may include magnetic elements disposed to influence the flight thereof when launched.

Accordingly, a play set and stunt arrangement is described which provides the entertainment and excitement of a toy vehicle launched from a track and which also includes provisions for returning the launched vehicle to the track in a proper orientation to allow continuous play despite any misalignment of the vehicle which may occur during flight.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A stunt arrangement for a toy vehicle, comprising:

a launching section configured to launch a propelled toy vehicle into flight;

a capturing section configured to receive the toy vehicle from the flight, including a narrowing cross-section configured to align a longitudinal axis of the toy vehicle with a desired direction of travel; and a reorienting section coupled to an outlet of the capturing section, the reorienting section being rotatably driven about the desired direction of travel and is configured to upright the toy vehicle if the vehicle exits the capturing section partly or completely inverted; and wherein the reorienting section further comprises a reorienting tube rotatable about a longitudinal axis thereof and including an element disposed at an interior thereof configured to engage a non-wheeled surface of the toy vehicle and to rotate the toy vehicle about the longitudinal axis.

2. The stunt arrangement according to claim 1, wherein the launching section comprises a track segment which extends to an angled position.

3. The stunt arrangement according to claim 1, further comprising a deflection section disposed between the launching section and the capturing section and configured to be impacted by the toy vehicle in flight and to redirect the vehicle toward the capturing section.

4. The stunt arrangement according to claim 1, further comprising a deflection section disposed between the launching section and the capturing section, the deflection section being positioned to be impacted by the toy vehicle in flight and to redirect the vehicle toward the capturing section and wherein the track segment comprises an upward curved portion that terminates at a generally vertical position, the arrangement further comprising a spine extending upwardly from the track segment, the spine supporting the deflection section.

5. The stunt arrangement according to claim 3, wherein the deflection section comprises a shield positioned above the launching section including a curvature to deflect the vehicle toward the capturing section and being composed of a transparent or semi-transparent material.

6. The stunt arrangement according to claim 1, wherein the capturing section comprises a funnel shaped collector with an opening at an upper end thereof that is significantly wider than a length of the toy vehicle and a tail portion disposed at a lower end of the collector where the tail has a generally curved longitudinal axis and includes a tapering cross-sectional area in a direction away from the collector.

7. The stunt arrangement of claim 6, wherein the curve traverses approximately ninety-degrees from a substantially vertical orientation at the collector to a substantially horizontal orientation at the reorienting section.

8. The stunt arrangement according to claim 1, wherein the reorienting tube is downwardly directed.

9. The stunt arrangement according to claim 1, wherein the element is further configured to allow a wheeled surface of the toy vehicle to roll across the element such that the toy vehicle passes through the interior to an outlet of the tube.

10. The stunt arrangement according to claim 1, wherein the element is further configured: to rotate the toy vehicle about a longitudinal axis of the vehicle such that a wheeled surface of the vehicle contacts the interior; and to disengage from the toy vehicle.

11. The stunt arrangement of claim 1, wherein the element comprises an elongated strip of material disposed on the interior generally parallel to the longitudinal axis.

12. The stunt arrangement of claim 11, wherein the element comprises a plurality of said strips disposed generally parallel to one another and extending substantially a length of the tube.

13. The stunt arrangement of claim 11, wherein the element comprises a rubber or plastic material adhered to the interior of the tube and wherein the tube is generally cylindrical in shape.

14. The stunt arrangement of claim 1, wherein the element comprises a plurality of rubber strips disposed on the interior of the tube extending from a first end of the tube to an opposing second end, the strips being positioned substantially parallel to the longitudinal axis, the strips being configured to engaged a non-wheeled surface of the toy vehicle and to rotate the toy vehicle onto a wheeled surface thereof.

15. A stunt arrangement for toy vehicles comprising:

a funnel section configured to receive a toy vehicle from flight;

a tail portion having a first end connected to a bottom of the funnel and a curve portion extending from the funnel through at least thirty degrees to a second end disposed opposite from the first end; and a cylinder located proximate to the second end and rotatable about a longitudinal axis of the cylinder, the cylinder including a plurality of frictional elements extending along an inner surface of the cylinder and generally parallel to the longitudinal axis;

wherein the funnel and tail portion are configured to position the received toy vehicle in a front or tail forward position and direct the toy vehicle into the cylinder in a direction of the longitudinal direction and the plurality of frictional elements are disposed to engage a non-wheeled surface of the toy vehicle and to rotate the vehicle about the longitudinal axis onto a wheeled surface thereof as the cylinder rotates about the longitudinal axis.

16. The stunt arrangement as in claim 1, wherein the reorienting section is rotatably driven by a motor.

17. The stunt arrangement as in claim 15, wherein the cylinder is rotated by a motor.

18. A toy track set, comprising:

a path for a toy vehicle to travel along, a first portion of the path being defined by a track connecting a launching portion with a capturing portion and a second portion of the path being defined by an air gap located between the launching portion and the capturing portion;

wherein the launching portion is configured to launch the toy vehicle into the air gap;

wherein the capturing portion is configured to capture the vehicle from the air gap;

wherein the capturing portion further comprises a rotating tube that receives the toy vehicle therein and directs the toy vehicle to the first portion of the path;

wherein the launching portion is configured to launch the toy vehicle in a first direction and a deflecting portion of the toy track set is configured to deflect the toy vehicle from the first direction towards a second direction, the second direction being different from the first direction and towards the capturing portion; and wherein the deflecting portion is positioned in the air gap and the deflecting is configured for deflecting the toy vehicle from the first direction;

wherein the deflecting portion is positioned in the air gap and the deflecting portion further comprises a flexible shield for deflecting the toy vehicle from the first direction.

19. The toy track set as in claim 18, wherein the deflecting portion is transparent.

20. The toy track set as in claim 18, wherein the deflecting portion has a curved shape.

21. The toy track set as in claim 18, wherein the rotating tube is rotated at a constant speed by a motor.

* * * * *